US006063274A

United States Patent [19]

Rivera

[11] Patent Number: 6,063,274

[45] Date of Patent: May 16, 2000

[54] SELF LEVELING SKIMMER

[76] Inventor: Ceferino Aponte Rivera, Plaza 34 MF-25 Marina Bahia, Catano, Puerto Rico 00962

[21] Appl. No.: 08/914,215

[22] Filed: Aug. 19, 1997

[51] Int. Cl.[7] ..... C02F 1/28; E02B 15/10

[52] U.S. Cl. ..... 210/242.3; 210/242.4; 210/923; 210/924

[58] Field of Search ..... 210/776, 242.3, 210/923, 242.4, 924

[56] References Cited

U.S. PATENT DOCUMENTS

| | | | |
|---|---|---|---|
| 2,330,508 | 9/1943 | McColl | 210/242.3 |
| 2,608,300 | 8/1952 | Small | 210/242.3 |
| 3,348,690 | 10/1967 | Cornelissen | 210/242.3 |
| 3,670,896 | 6/1972 | Hale, Jr. et al. | 210/242.3 |
| 3,688,909 | 9/1972 | Titus et al. | 210/242.3 |
| 3,727,766 | 4/1973 | Horne et al.. | 210/242.3 |
| 3,822,789 | 7/1974 | Crisafulli | 210/242.3 |
| 3,923,649 | 12/1975 | Sparham et al. | 210/715 |
| 3,923,661 | 12/1975 | Crisafulli | 210/242.3 |
| 3,935,103 | 1/1976 | Disque et al. | 210/97 |
| 4,085,049 | 4/1978 | Hartwick et al. | 210/242.3 |
| 4,288,324 | 9/1981 | Urdanoff | 210/242.1 |
| 4,405,458 | 9/1983 | McHugh, Jr. | 210/242.3 |
| 4,551,244 | 11/1985 | Inoue | 210/198.1 |
| 4,554,079 | 11/1985 | Wingard et al. | 210/776 |
| 4,802,592 | 2/1989 | Wessels | 210/169 |

*Primary Examiner*—Ivars Cintins

[57] ABSTRACT

A self-leveling skimmer attached to a boat is designed to remove a top surface layer of liquid while maintaining a constant position relative to the surface of the liquid layer. While maintaining a constant position relative to the top surface layer of liquid, the device provides for continuous removal of the top surface layer of liquid of a constant thickness regardless of changes in the elevation of the surface of the top liquid layer. The device includes multiple hollow bodies that rotate independently about a shaft. The shaft is situated parallel to the surface of the top liquid layer. Each hollow body has a lengthwise opening. The edge closest to the top surface layer of liquid forms a weir. The weir has a repetitive triangular or V-notch shape. A suction line extends into each hollow body so as to remove the liquid collected therein. Each hollow body is capable of rotating about the shaft. When the buoyant torque is greater than the gravitational torque, the hollow body rotates in such a manner so as to lower the weir below the surface of the top liquid layer, thus allowing the fluid to enter the hollow body. Once the gravitational torque exceeds the buoyant torque, the hollow body will then rotate in an opposite direction so as to raise the weir above the surface of the top liquid layer. The device achieves this action by providing for a pivot location of the hollow body which is offset from the longitudinal axis of the hollow body. Therefore, the position of the weir stays relatively constant in relation to the top surface layer of liquid.

21 Claims, 4 Drawing Sheets

FIG. 5
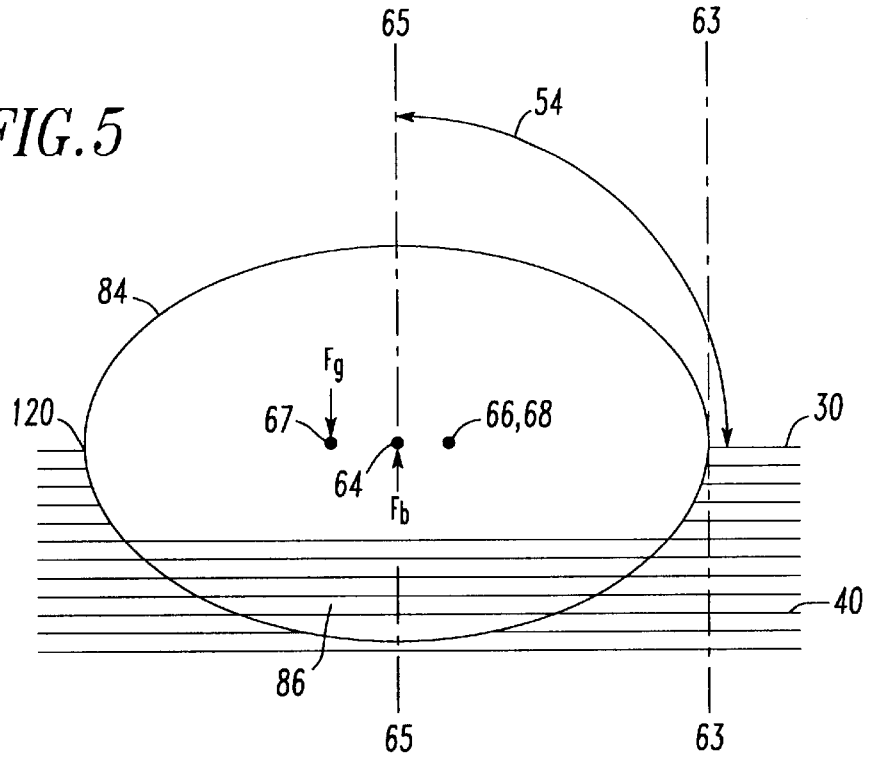
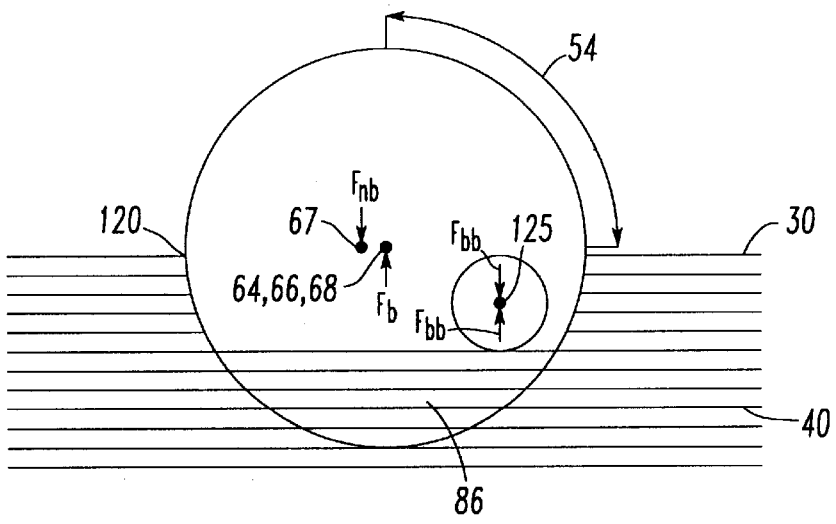
FIG. 7

SELF LEVELING SKIMMER

BACKGROUND OF THE INVENTION

1. Field of the Invention

This invention concerns a device which can skim a relatively thin top surface layer of liquid which lies atop a bottom layer of liquid, in for example, a body of water. The invention more particularly concerns a skimming device that is self-leveling and can be used onboard a boat so as to skim a top liquid layer from atop a bottom liquid layer in a large, open body of the bottom liquid layer.

2. Discussion of the Background

Related skimmers have a number of shortcomings which can result in recovery of a top liquid layer and a bottom liquid layer, such as oil and water, respectively, which contains a large amount of the bottom liquid layer (water) when it is to be desired to skim only the top liquid layer (oil). Also, related skimming devices are known to be dynamically unstable. Ideally, a skimming device provides for skimming the lowest possible amount of skimmed bottom liquid layer (water) and/or entrains the lowest possible amount of air while skimming the maximum amount of the top liquid layer (oil).

In one type of related device, skimmers were used to remove, for example, a floating layer of oil resting atop a body of water due to an oil spill. In this device, the system would literally suck or vacuum the top liquid layer of oil from the body of water. The vacuum device, ideally, would be located as near as possible to the surface of the oil layer to maximize the ratio of oil to water removed, yet it would be located far enough away from the surface of the oil so that it would not be likely that water would be vacuumed. This is desirable since a large ratio of oil to water reduces the time and effort spent on any subsequent oil/water separation operations. However, locating the vacuuming device far enough away from the surface of the top liquid layer, so as to minimize the amount of water vacuumed, increases the possibility of entraining air into the system due to water level fluctuations. Entrained air introduced into the pumping system can cause pump cavitation, air lock, and interruption of operation. Thus, the location of the vacuuming device relative to the surface of the top liquid layer is a compromise between minimizing the volume of air entrained or minimizing the volume of water removed.

In another type of related device a hollow, general-shaped vessel is rotatably attached to a floating platform which is used in a small reservoir. The general-shaped vessel has an open section, the lower most edge forming a weir. The general-shaped vessel, when viewed from one side end thereof, tilts clockwise when the vessel is not filled with liquid, at such a time liquid flows over the weir and is introduced into the interior of the general-shaped vessel. When the gravitational moment or torque of the liquid about the pivot point exceeds the buoyancy moment which acts in the opposite, counterclockwise, direction the general-shaped vessel rotates counterclockwise so as to stop the influx of fluid into the general-shaped vessel. A suction line leading into the general-shaped vessel is used to evacuate any liquid contained inside the general-shaped vessel. When the vessel begins to empty the general-shaped vessel rotates clockwise, thus introducing more liquid into the interior of the general-shaped vessel once the buoyancy force moment, which acts in a clockwise direction, exceeds the gravitational moment of the liquid remaining inside the general-shaped vessel. In practice, it has been found, as disclosed by the related art, that when the input supply of liquid to the reservoir fluctuates fairly rapidly the skimmer may rather abruptly rock up and down continuously, and hard stops are employed to limit the magnitude of the rotation of the general-shaped vessel.

Thus, there is a need for a skimmer which does not entrain air, does not skim too much water along with the desirably skimmed oil, and acts dynamically stable when faced with a fluctuating input supply of liquid.

SUMMARY OF THE INVENTION

It is an object of the invention to provide a skimming device which can be used on a large body of liquid to remove a top liquid layer from atop a bottom liquid layer in a dynamically stable manner without introducing entrained air, or skimming too much of the bottom liquid layer.

In one form of the invention the self-leveling skimmer takes the form of at least one hollow body attached to a boat. Each hollow body has a lengthwise opening so that the desirably skimmed top liquid layer is introduced to the inside of the hollow body. The edge of the lengthwise opening closest to the top liquid layer forms a weir. The weir has a repetitive triangular shape or V-notch shape. The hollow body rotates about a longitudinal axis that is parallel to the top liquid layer when the top liquid layer is motionless, i.e., no wave action. Each hollow body is rotatably connected to a shaft which is connected to the boat. The shaft intersects end walls of each hollow body at a position somewhere between a vertical plane extending through, and along, the longitudinal axis and a vertical plane extending through, and along, the weir edge. Liquid which is introduced into the hollow body is discharged from the hollow body through a suction line which is provided inside each hollow body.

In yet another form of the invention the self-leveling skimmer takes the form of one or more hollow bodies attached to a boat. Each hollow body has a lengthwise opening. The edge of the lengthwise opening closest to the top liquid layer forms a weir. The weir has a repetitive triangular shape or V-notch shape. Each hollow body rotates about a longitudinal axis which is parallel to the surface of the top liquid layer when the top liquid layer is at rest. Each hollow body rotates about the longitudinal axis independently of the any other hollow body. A shaft which connects each hollow body to the boat intersects end walls of each hollow body along their longitudinal axes. A buoyant body spans the inner length of each hollow body. The buoyant body has its position fixed within the hollow body since it is attached to the end walls. The buoyant body is located between a vertical plane extending through, and along, the hollow body longitudinal axis and a vertical plane extending through, and along, the weir edge of the hollow body. A suction line is introduced into the interior of the hollow body so as to extract the skimmed liquids.

In another form of the invention the self-leveling skimmer takes the form of at least one hollow body rotatably connected to a boat through means for rotatably supporting each hollow body. Each hollow body has a lengthwise opening. The edge of the lengthwise opening closest to the top liquid layer forms a weir. The weir has a repetitive triangular shape or V-notch shape. Each hollow body has a longitudinal axis which is parallel to the top liquid layer when the top liquid layer is at rest. Each hollow body rotates about a point which is located between a vertical plane extending through, and along, the longitudinal axis and a vertical plane extending through, and along, the hollow body weir edge. A means for extracting the skimmed liquids from inside each hollow body is provided.

Thus, Applicant's invention is superior to the related art. Applicant's invention provides a self-leveling skimmer which is used in conjunction with a boat to skim a top surface layer of liquid from a bottom layer of liquid on an open body of the bottom liquid. Applicant's invention provides a self-leveling skimmer which adjusts to changing elevations in the position of the top liquid layer through use of the boat, and provides for dynamic stability of the self-leveling skimmer through use of triangular shaped weirs and selective placement of the pivot or buoyant body location.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 5 is a partial, cross-sectional side view of another embodiment of the self-leveling skimmer device in a body of liquid;

FIG. 7 is a partial, cross-sectional side view of a hollow body of another embodiment of the self-leveling skimmer device in a body of liquid.

DESCRIPTION OF THE PREFERRED EMBODIMENTS

Figure 1:
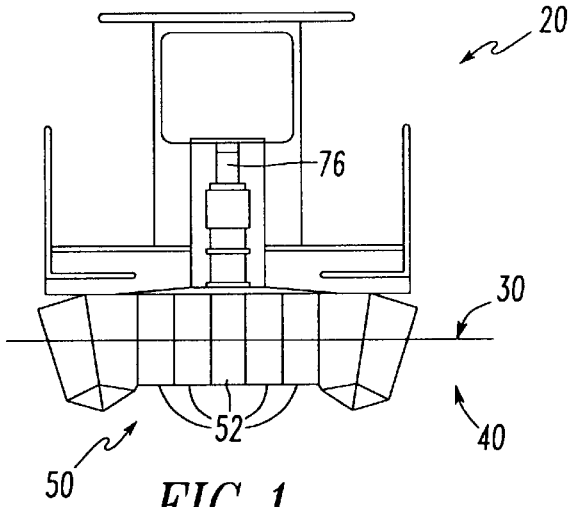
FIG. 1 is a front plan view of a boat outfitted with a self-leveling skimmer device of the present invention.

Referring now to the drawings, wherein like reference numerals designate identical or corresponding parts throughout the several views, and more particularly to FIG. 1 thereof, a self-leveling skimmer 50 has been created which provides for stable skimming of a top liquid layer on an open body of water. An embodiment of this invention is displayed in FIGS. 1–6. FIG. 1 is a front plan view of a boat 20 mounted with a self-leveling skimmer 50. The boat 20 is in an open body of, for example, water, which includes a bottom liquid layer 40, on top of which is situated a top liquid layer 30.

Figure 2:
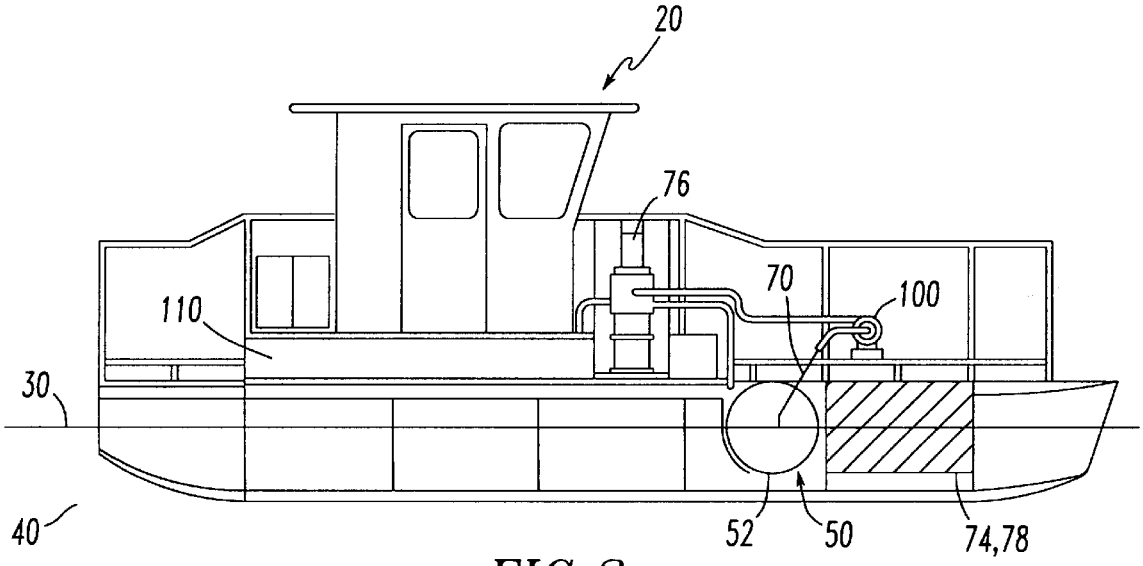
FIG. 2 is a partial, cross-sectional side view of the boat outfitted with a self-leveling skimmer device.

FIG. 2 is a plan view of the boat 20, in partial cross-section, floating on the bottom liquid layer 40. Atop the bottom liquid layer 40 rests the top liquid layer 30 which is to be skimmed. FIG. 2 further illustrates the relationship between the components of the self-leveling skimmer 50 in which a cylindrical hollow body 52 is attached to the boat 20. As also illustrated in FIG. 2, a suction line 70 extends into the cylindrical hollow body 52 to remove any liquids therein, a pump 100 creates the suction to move the liquid through the suction line 70, an oil/water separator 76 is attached to the suction line 70 and is used to separate the skimmed oil from the skimmed water, and the separated oil is then deposited into a holding tank 110. Furthermore, wave stilling baffles 74 and an oleophilic mat 78 are attached to the boat 20 to reduce the effects of waves and to increase the thickness of the oil layer to be skimmed, respectively.

Figure 3:
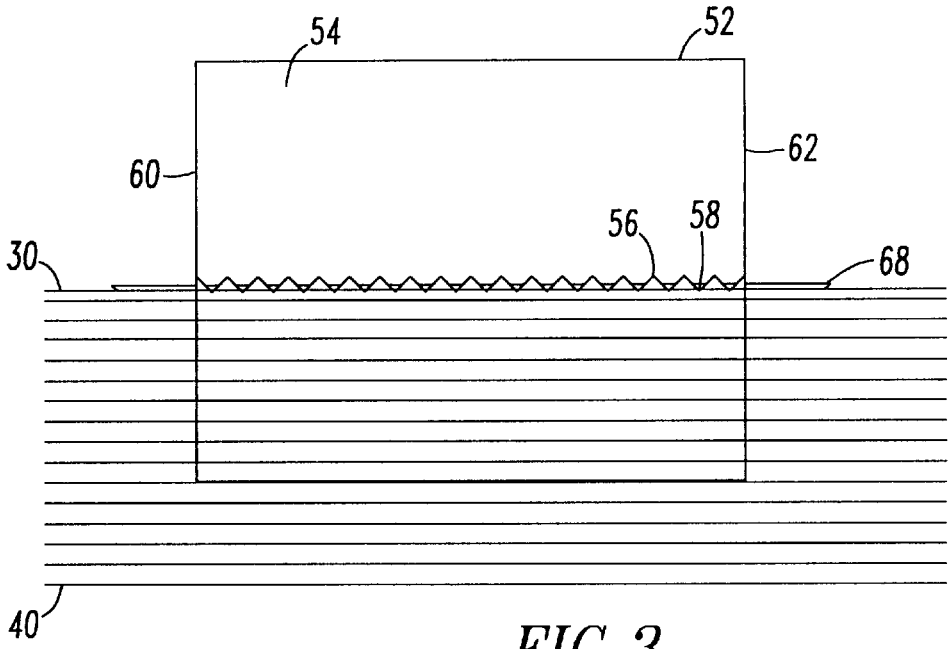
FIG. 3 is a front view of a hollow body of the self-leveling skimmer device in a body of liquid.

FIG. 3 is a front plan view of a cylindrical hollow body 52 of the self-leveling skimmer 50. FIG. 3 illustrates the cylindrical hollow body 52 having a lengthwise opening 54, end walls 60, 62, and a shaft 68 which penetrates end walls 60, 62. The cylindrical hollow body 52 is shown to be partially immersed in a bottom liquid layer 40, atop of which rests a top liquid layer 30 which is to be skimmed. An edge of the lengthwise opening 54 closest to the top liquid layer 30 forms a weir 56. The weir 56 has a repetitive triangular or V-notch shape 58.

Figure 4:
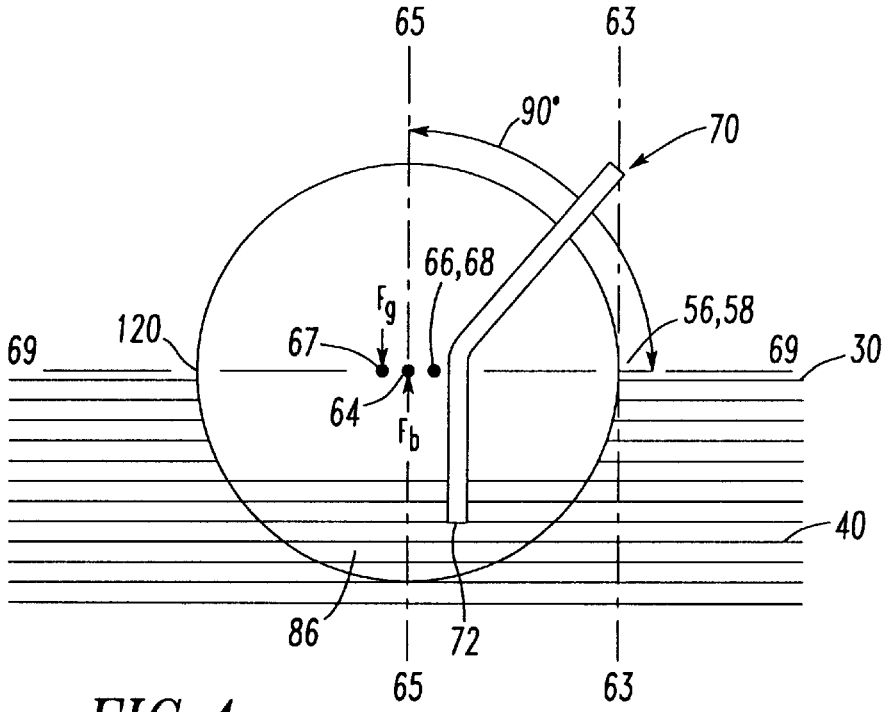
FIG. 4 is a partial, cross-sectional side view of the hollow body of the self-leveling skimmer device in a body a liquid.

FIG. 4 is a side, cross-sectional view of the cylindrical hollow body 52 of the self-leveling skimmer 50. FIG. 4 illustrates the suction line 70 extending into the cylindrical hollow body 52 so as to extract the liquid 86 therein, the suction being provided by the pump 100 (not shown in this figure). The lengthwise opening 54 is shown to extend over a ninety degree arch. However, it is understood that the lengthwise opening 54 can extend over an angle greater than or less than ninety degrees based on design considerations. Again the cylindrical hollow body 52 is shown to be a partially immersed in a bottom liquid layer 40 atop which rests a top liquid layer 30. The suction line 70 has an end 72 through which the liquid 86 inside the cylindrical hollow body 52 is extracted. The cylindrical hollow body 52 rotates about pivot connections 66, 66. The longitudinal axis 64 is displayed through which the buoyant force $F_b$ acts. The gravitational force of the cylindrical hollow body 52 and any liquid 86 therein reacts through the center of gravity of the system 67 which is shown by the force vector $F_g$. The end of the shaft 68 around which the cylindrical hollow body 52 rotates is collinear with the pivot connections 66, 66. Also shown in FIG. 4 is a vertical plane 63 which extends through the weir edge 56, another vertical plane 65 which extends through the longitudinal axis 64, and a line 69 which extends through the weir edge 58 and the longitudinal axis 64.

Figure 6:
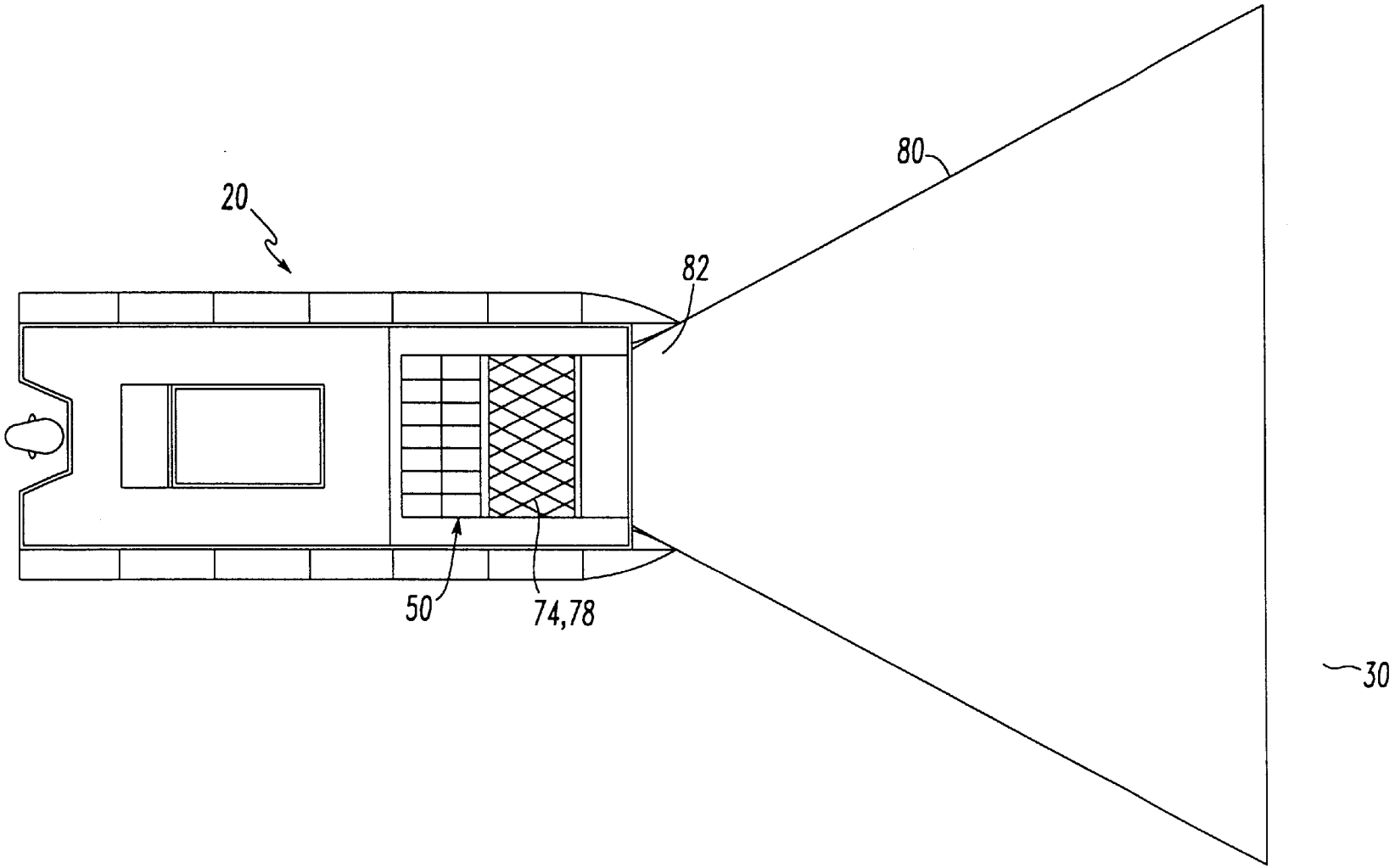
FIG. 6 is a top plan view of a boat outfitted with a self-leveling skimmer device, and a boom.

FIG. 5 is a side, cross-sectional view of a hollow body 52 having the shape of an ellipse 84. However, it is understood that a shape other than an ellipse may be used as the hollow body based on design considerations. Features of the ellipse 84 are denoted with numeral designators which are the same for similar features of the cylindrical body shown in FIG. 4. FIG. 6 is a top plan view of the boat 20. The boat 20 is shown to have a boom 80. The boom 80 has a narrowed portion or vertex 82. FIG. 6 also illustrates the location of the self-leveling skimmer 50, the wave stilling baffles 74, and the oleophilic mat 78.

The self-leveling skimmer 50 as illustrated in FIG. 1 shows multiple cylindrical hollow bodies 52 attached to the boat 20 by a shaft 68. The boat 20 floats on the bottom liquid layer 40. On top of the bottom liquid layer 40 rests the top liquid layer 30 which is desired to be skimmed from the surface of the bottom liquid layer 40. FIG. 2 further illustrates the use of wave stilling baffles 74 which are located upstream of the weir 56 of each hollow body 52 of the self-leveling skimmer 50. Also, upstream of each weir 56 is an oleophilic mat 78. Attached further upstream of each weir 56 and upstream of the wave stilling baffles 74 and the oleophilic mat 78 is a boom 80 which has a vertex 82 attached to the boat 20. One end 72 of a suction line 70 extends into the cylindrical hollow body 52 so as to extract liquid 86 therein. Suction is provided to the suction line 70 by means of a pump 100. The pump 100 further directs the flow of liquid 86 from the cylindrical hollow body 52 into an oil/water separator 76. The oil/water separator 76 separates the skimmed top liquid layer 30 which is to be extracted from the bottom liquid layer 40. The oil/water separator 76 discharges the bottom liquid layer 40 (water) overboard, and discharges the extracted top liquid layer 30 (oil) into a holding tank 110, as shown in FIG. 2.

The cylindrical hollow body 52 of the self-leveling skimmer 50 has end walls 60, 62 at both ends of the cylinder, as shown in FIG. 3. Each cylindrical hollow body 52 of the self-leveling skimmer 50 has a lengthwise opening 54. The edge of the lengthwise opening 54 closest to the top liquid layer 30 forms a weir 56. The weir 56 has a repetitive triangular or V-notch shape 58. The lengthwise opening 54 spans a ninety degree arch around the circumference of the cylindrical hollow body 52, as shown in FIG. 4. However, it is understood that the lengthwise opening 54 can extend over an angle greater than or less than ninety degrees based on design considerations. An imaginary plane 63 extends in a vertical direction and is coincident with the weir edge 56, and another imaginary plane 65 extends through the longitudinal axis 64 of the cylindrical hollow body 52, as shown in FIG. 4. An imaginary plane 69 extends through the weir edge 56 and additionally extends through the longitudinal axis 64. The pivot connections 66 of the cylindrical hollow body 52 lie on imaginary plane 69 between the imaginary planes 63, 65, as shown in FIG. 4. The shaft 68 is rotatably connected to the cylindrical hollow body 52 at the pivot connections 66, 66 which exists at each end wall 60, 62 of each hollow body 52 of the self-leveling skimmer 50. The buoyant force is depicted as a resultant force $F_b$ being applied at the longitudinal axis 64, and the gravitational force of the cylindrical hollow body 52 and liquids 86 therein are depicted as a resultant force $F_g$ applied at the center of gravity of the system 67.

When the cylindrical hollow body 52 of the self-leveling skimmer 50 is initially placed in the bottom liquid layer 40, the interior of the cylindrical hollow body 52 contains no liquid 86. Thus, the buoyant force $F_b$, which is equivalent to the gravitational force $F_g$ of the cylindrical hollow body 52 but acts in a different direction, and is equal to the weight of the bottom liquid layer 40 displaced by insertion of the cylindrical hollow body 52 therein. Initially, since the cylindrical hollow body 52 does not contain liquid 86, the gravitational force $F_g$ consists of only the weight of the cylindrical hollow body 52; since the cylindrical hollow body 52 is attached to the boat 20 via the shaft 68, the cylindrical hollow body 52 is forced into the bottom liquid layer 40. As such, the cylindrical hollow body 52 displaces more of the bottom liquid layer 40 than it normally would if it was not attached to the shaft 68. Therefore, the buoyant moment is greater than the gravitational moment, as such, the cylindrical hollow body 52 rotates about the pivot connections 66, thus, lowering the weir 56 below the floatation line 120. At that time, the top liquid layer 30 and some of the bottom liquid layer 40 flow over the weir 56 and into the cylindrical hollow body 52.

As the liquids 30, 40 flow into the cylindrical hollow body 52 the gravitational force $F_g$ of the system increases. As the gravitational force $F_g$ increases the cylindrical hollow body 52 then rotates in a direction so that the weir 56 is raised and becomes in line with or is raised above the floatation line 120. At such a position the gravitational and buoyant moments are in equilibrium. The cylindrical hollow body 52 will stay in this position unless the liquid 86 contained within the cylindrical hollow body 52 is removed, thus reducing the gravitational force $F_g$ of the system, thus resulting in the cylindrical hollow body 52 rotating so that the weir 56 is brought closer to the floatation line 120, thus allowing the top liquid layer 30 and some of the bottom liquid layer 40 to flow into the interior of the cylindrical hollow body 52. The liquid 86 inside the cylindrical hollow body 52 is removed through the end 72 of the suction line 70. As the example shows, in a steady state operation, the hollow body 52 of the self-leveling skimmer 50 is able to skim the liquids 30, 40 at the same rate as the liquid 86 is removed from the interior of the cylindrical hollow body 52 through the suction lines 70.

The repetitive triangular-shape 58 of the weir 56 of the cylindrical hollow body 52 allows the liquids 30, 40 to flow into the interior of the cylindrical hollow body 52 at a known rate, since the flow of liquid through a triangular or V-notch weir is known. The repetitive triangular-shape 58 of the weir 56 provides for a more dynamically stable system since the liquids 30, 40 flow over the weir 56 at a known rate at a constant weir 56 position, for example, the cylindrical hollow body 52 need not rotate so as to allow liquid to flow over the weir. Related weir designs that consisted of a straight edge were not as dynamically stable since the liquids either flowed over the top of the weir or they did not, i.e., the cylindrical body must rotate one way or another to let fluid in or to stop the inflow of fluid.

The speed with which the self-leveling skimmer 50 rotates about the pivot connections 66, 66 depends on the net torque applied to the system, the mass moment of inertia of the system, the frictional torque between the shaft 68 and the pivot connections 66, and the amount of drag between the bottom liquid layer 40 and the outer surface of the cylindrical hollow body 52. The most effective parameter with which to influence the speed of rotation of the self-leveling skimmer about the pivot connections 66 is to analyze the net torque applied to the system. The net torque is a function of the gravitational force $F_g$ acting through the center of gravity 67 multiplied by the horizontal distance between a vertical plane extending through the center of gravity 67, while being parallel to the longitudinal axis, and a vertical plane extending through the pivot connections 66, and the buoyant force $F_b$ acting through and perpendicular to the longitudinal axis 64 multiplied by the horizontal distance between a vertical plane extending through the longitudinal axis 64 and a vertical plane extending through the pivot connections 66. Thus, if the pivot connections 66, 66, the center of gravity 67, and a point on the longitudinal axis 64 would all be approximately collinear a large net torque results in a self-leveling skimmer 50 which reacts quickly to liquid level changes. The larger the offset distance between the pivot connections 66, 66 and the gravitational force $F_g$ and the buoyant force $F_b$, results in a large net torque. Thus, a large offset distance is desired. The distance between the two force vectors $F_g$ and $F_b$ influence the magnitude of the net torque, however during non-static conditions either one of $F_g$ or $F_b$ overwhelms the other force vector so as to be the dominant force term in the net torque equation. Therefore, the distance between the two force vectors $F_g$, $F_b$ is not too critical.

Ideally the pivot connections 66, the center of gravity 67, and the longitudinal axis 64 lie as near as possible to the floatation line 120, resulting in a floatation line 120 at about the middle of the cylindrical hollow body 52. When the self-leveling skimmer 50 is used on a boat 20 during anticipated wavy sea conditions, the pivot connections 66 should be located at an average surface elevation of the top liquid layer 30. Additionally, the diameter of the cylindrical hollow body 52 is determined by the magnitude of the expected fluctuations. Increasing the offset distance increases the response speed of the system, however, if the diameter of the cylindrical hollow body 52 is not increased accordingly the distance from the pivot connections 66 to the weir edge 56 is reduced, thus resulting in a reduced range of level fluctuations that the cylindrical hollow body 52 can accommodate.

Onboard boat 20, preferably, multiple cylindrical hollow bodies 52 are used as shown in FIG. 1. In such a case, each cylindrical hollow body 52 rotates independently of the other cylindrical hollow bodies 52 in order to accommodate lateral waves. It is anticipated that such a boat would be able to remove a top liquid layer 30 of oil, an inch thick, at a flow rate of approximately 30 gallons per minutes. As an example, five cylindrical hollow bodies 52 can be employed. However, it is understood that the number of cylindrical hollow bodies 52 to be used can be based on design considerations. As an example, each cylindrical hollow body 52 can have a diameter of 36 to 40 inches, a length of six to twelve inches, and can be made of aluminum, fiber reinforced plastic, polypropylene, and steel. The main requirements of an adequate material are lightness of weight and structural integrity. As a further example, the pivot connections 66 can be located along a line between the weir edge 56 and the longitudinal axis 64, one-half inch to three inches away from the longitudinal axis 64 in each of the end walls 60, 62. Also, the shaft 68 can be made of aluminum, steel, fiber reinforced plastic, in the form of an hollow cylinder, tube, or pipe, so as to be light in weight and have structural integrity.

In a further embodiment of the invention, wave stilling baffles 74 are used to reduce the effect of the waves on the performance of the cylindrical hollow bodies 52. The wave stilling baffles 74, as shown in FIG. 2, are attached to the boat 20 and are positioned upstream of the weirs 56. The wave stilling baffles 74 are multiple, parallel, corrugated, metal plates. The parallel metal plates of the wave stilling baffles can be vertical in relation to the boat 20 and to the cylindrical hollow bodies 52 and parallel relative to each other, so that the plates absorb wave energy while allowing water/oil to flow with minimum interference.

The suction line 70 can be made of, for example. PVC, polypropylene, aluminum, fiber reinforced plastic, stainless steel, and steel. The main requirements of a suction line material are yhat it be resistant to corrosion, light in weight, and have structural integrity. Also, the suction line 70 can have an internal diameter of, for example, one-half inch to three inches; the internal diameter size depends on design considerations such as the amount of flow and the velocity of the flow through the suction line. The above-discussion shows that the dimensions used are based on design consideration. Thus, various embodiments of the present invention may result in use of different dimensions, and as such the dimensions disclosed in this specification are non-limiting.

In another form of the invention instead of using a hollow body 52 having a cylindrical shape as shown in FIG. 4, an elliptical hollow body 84 is employed in the self-leveling skimmer 50, as shown in FIG. 5. All other features of the elliptical hollow body 84 are similar to those of the cylindrical hollow body 52. The functioning of the elliptical hollow body 84 is similar to that of the cylindrical hollow body 52, therefore the operational aspects of the elliptical hollow body 84 as part of a self-leveling skimmer 50 are not discussed here. Such a shape may have advantages in use where the bottom liquid layer 40 is shallow and where the liquid surface fluctuations are large. Such an embodiment can be used in conjunction with the other features described above such as the wave stilling baffles 74, the oil/water separator 76, the oleophilic mat 78, and the boom 80.

In another embodiment a boom 80, as shown in FIG. 6, is attached to the boat 20 which has the self-leveling skimmer 50. The boom 80 attaches to the boat 20 at the narrowest end of the boom defining a vertex 82. The boom enables the boat 20 to collect a top liquid layer 30 and thicken the layer by channeling it through the narrow vertex 82 so as to speed up the skimming process and also allows the self-leveling skimmer 50 to collect a greater ratio of the top liquid layer 30 in relation to the bottom liquid layer 40.

Another feature which is used in place of or in conjunction with the waves stilling baffles 74 is the use of an oleophilic mat 78. The oleophilic mat 78 absorbs the energy of waves and at the same time has an affinity for oil, which would typically constitute the top liquid layer 30 which is desired to be skimmed. Thus, the self-leveling skimmer would collect a greater ratio of the top liquid layer 30 in relation to the bottom liquid layer 40. The oleophilic mat is connected to the boat 20.

Another feature that can be used in conjunction with all other features so far discussed is an oil/water separator 76 typically of the centrifugal variety that is able to discard water, which is typically the bottom liquid layer 40 collected during the skimming process. The oil, which is typically the top liquid layer 30, is stored onboard the boat 20 in a storage tank 110. The recovered oil can then later be discharged in an appropriate manner.

In another embodiment of the invention, the pivot connections 66, 66 are collinear with the longitudinal axis 64, as shown in FIG. 7, instead of being offset as shown in the previous embodiments. As such, the resultant of the buoyant force $F_b$ acts through the pivot connections 66, thus resulting in no torque as produced by the buoyant force $F_b$ as described in the earlier embodiments. However, a force due to buoyancy of a buoyant body 124 is created. The buoyant body 124 is situated within the interior of the cylindrical hollow body 52 and attaches to the end walls 60, 62 thereof. The longitudinal axis of the buoyant body 124 is parallel to the longitudinal axis 64 of the cylindrical hollow body 52. The buoyant force created by the buoyant body 124 acts at the centroid 125 of the buoyant body 124, denoted as $F_{bb}$, as shown in FIG. 7. Now, the torque due to the buoyant force of the buoyant body is a function of the magnitude of that force and the horizontal distance between a vertical plane extending through the centroid of the buoyant body 124 and a vertical plane extending through the pivot connections 66, 66.

The torque due to the gravitational force $F_g$ is composed of the gravitational force of the cylindrical hollow body 52, shown as $F_{hb}$ in FIG. 7, and the horizontal distance between the center of gravity 67 and the pivot connections 66; this torque component is relatively small due to the small distance involved, and as such can be ignored. Also the gravitational force $F_g$ is composed of the weight of the buoyant body 124 acting through its centroid, shown as $F_{gbb}$ in FIG. 7. The moment arms calculated for the buoyant force $F_{bb}$ of the buoyant body 124 also apply to the gravitational force $F_{gbb}$ of the buoyant body 124. Thus, when no liquid 86 is inside the cylindrical hollow body 52 there is no buoyant force due to the buoyant action of the buoyant body 124.

Therefore, the gravitational torque of the buoyant body is larger than the buoyant torque of the buoyant body 124, as such, the cylindrical hollow body 52 rotates so as to bring the weir 56 below the surface of the top liquid layer 30. The top liquid layer 30 will continue to flow into the cylindrical hollow body 52, until the liquid 86 therein surrounds enough of the buoyant body 124 so as to produce a buoyant force $F_{bb}$ to create a torque due to buoyancy which is greater than the torque due to gravity thus rotating the cylindrical hollow body 52 in a opposite direction so as to raise the weir 56 above the surface of the top liquid layer 30. Once the torques are in equilibrium, the position of the cylindrical hollow body 52 remains constant. Thus, the cylindrical hollow body 52 that employs a buoyant body 124 rotates as if the pivot connections 66 were offset from the longitudinal axis 64. The operation of the cylindrical hollow body 52 employing the buoyant body 124 is similar to the embodiments described above.

In the above-mentioned embodiments where specific materials, dimensions, and shapes were discussed it must be understood that they are based on design considerations and may vary on the application. Such considerations include but are not limited to the size of the boat, operation in open seas or a small bay, roughness of the seas, and the size of lateral waves.

Obviously, numerous modifications and variations of the present invention are possible in light of the above teachings. It is therefore to be understood that within the scope of the appended claims, the invention may be practiced otherwise than as specifically described herein.

What is claimed as new and is desired to be secured by Letters Patent of the United States is:

1. A self-leveling skimmer mounted on a boat for skimming a top liquid layer from atop a bottom liquid layer, the self-leveling skimmer comprising:

at least one hollow body, said at least one hollow body having a lengthwise opening forming a weir on one edge surface of said opening nearest the top liquid layer, said weir having a repetitive triangular shape, said at least one hollow body having end walls at each terminal end of said at least one hollow body, said at least one hollow body having a longitudinal axis which extends transverse to a bow-to-stern axis of the boat and parallel to a surface of the top liquid layer and being independently rotatable about said longitudinal axis;

a shaft rotatably connecting said at least one hollow body to the boat, said shaft being parallel to said longitudinal axis of said at least one hollow body, said shaft being rotatably connected to said end walls of said at least one hollow body at a location between a vertical plane extending through said longitudinal axis of said at least one hollow body and a vertical plane extending through the edge surface of said weir; and a suction line provided for said at least one hollow body, said suction line having an end which extends into said at least one hollow body so as to remove liquid therein.

2. A self-leveling skimmer as recited in claim 1, further comprising an oil/water separator attached to an output end of said suction line.

3. A self-leveling skimmer as recited in claim 1, further comprising wave stilling baffles attached to the boat upstream of said weir.

4. A self-leveling skimmer as recited in claim 1, further comprising an oleophilic mat attached to the boat upstream of said weir.

5. A self-leveling skimmer as recited in claim 1, further comprising a boom attached to the boat, said boom having a vertex located upstream of said weir in a direction of flow of liquid to the weir so as to direct the flow of liquid into said at least one hollow body.

6. A self-leveling skimmer as recited in claim 5, further comprising wave stilling baffles attached to the boat adjacent said vertex of said boom, said wave stilling baffles located upstream of said weir.

7. A self-leveling skimmer as recited in claim 5, further comprising an oleophilic mat attached to the boat adjacent said vertex of said boom, said oleophilic mat located upstream of said weir.

8. A self-leveling skimmer as recited in claim 1, wherein said shaft is rotatably connected to said at least one hollow body at a location on an imaginary plane extending from said longitudinal axis of said at least one hollow body to said weir edge.

9. A self-leveling skimmer as recited in claim 1, wherein said at least one hollow body has a cross-sectional shape of a cylinder.

10. A self-leveling skimmer as recited in claim 9, wherein said lengthwise opening of said at least one hollow body has an arcuate shape of ninety degrees.

11. A self-leveling skimmer as recited in claim 9, wherein said at least one hollow body has a diameter greater than its length.

12. A self-leveling skimmer as recited in claim 1, wherein said at least one hollow body has a cross-sectional shape of an ellipse, an weir of said at least one hollow body located adjacent a major axis of said ellipse.

13. A self-leveling skimmer mounted on a boat for skimming a top liquid layer from atop a bottom liquid layer, the self-leveling skimmer comprising:

at least one hollow body having a lengthwise opening forming a weir on one edge surface of said opening nearest the top liquid layer, said weir having a repetitive triangular shape, said at least one hollow body having end walls at each terminal end of said at least one hollow body, said at least one hollow body having a longitudinal axis, which longitudinal axis is parallel to a surface of the top liquid layer and is independently rotatable about said longitudinal axis;

a shaft rotatably connecting said at least one hollow body to the boat, said shaft being situated along said longitudinal axis of said at least one hollow body, said shaft being rotatably connected to said end walls of said at least one hollow body and being attached to said boat extending transversely to a bow-to-stern axis of the boat in a manner causing the height of the at least one hollow body to be set relative to the liquid layer by said boat;

a buoyant body spanning an inner length of said at least one hollow body which is attached to said end walls of said at least one hollow body, said buoyant body located between a vertical plane extending through said longitudinal axis of said at least one hollow body and a vertical plane extending through the edge surface of said weir; and a suction line provided for said at least one hollow body, said suction line having an end which extends into said at least one hollow body so as to remove the liquids therein.

14. A self-leveling skimmer as recited in claim 13, wherein said at least one hollow body has a cross-sectional shape of a cylinder.

15. A self-leveling skimmer as recited in claim 14, wherein said lengthwise opening of said at least one hollow body has an arcuate shape of ninety degrees.

16. A self-leveling skimmer as recited in claim 14, wherein said at least one hollow body has a diameter greater than its length.

17. A self-leveling skimmer as recited in claim 13, wherein said at least one hollow body has a cross-sectional shape of an ellipse, and said weir of said at least one hollow body being located adjacent a major axis of said ellipse.

18. A self-leveling skimmer as recited in claim 13, further comprising wave stilling baffles attached to the boat upstream of said at least one hollow body weir.

19. A self-leveling skimmer mounted on a boat for skimming a top liquid layer from atop a bottom liquid layer, the self-leveling skimmer comprising:

at least one hollow body having a lengthwise opening forming a weir on one edge surface of said opening nearest the top liquid layer, said weir having a repetitive triangular shape, said at least one hollow body having end walls at each terminal end of said at least one hollow body, said at least one hollow body having a longitudinal axis which extends transverse to a bow-to-stern axis of the boat and parallel to the top liquid layer;

means for rotatably supporting said at least one hollow body, said means for rotatably supporting being connected to the boat so that said at least one hollow body pivots about an axis at a location between a vertical plane extending through said longitudinal axis of said at least one hollow body and a vertical plane extending through the edge surface of said weir; and means for extracting the liquids from inside said at least one hollow body.

20. A self-leveling skimmer as recited in claim 19, further comprising wave stilling baffles attached to the boat upstream of said weir of said at least one hollow body.

21. A self-leveling skimmer mounted on a boat for skimming a top liquid layer from atop a bottom liquid layer, the self-leveling skimmer comprising:

a plurality of cylindrical hollow bodies each having a lengthwise opening forming a weir on one edge surface of said opening nearest the top liquid layer, each weir having a repetitive triangular shape, said plurality of cylindrical hollow bodies having end walls at each terminal end of said plurality of cylindrical hollow bodies, said plurality of cylindrical hollow bodies each having a longitudinal axis which extends transverse to a bow-to-stern axis of the boat and parallel to the top liquid layer;

means for rotatably supporting said plurality of cylindrical hollow bodies, said means for rotatably supporting being connected to the boat so that said plurality of cylindrical hollow bodies pivot about an axis at a respective location between a vertical plane extending through said longitudinal axis of each of said plurality of cylindrical hollow bodies and a vertical plane extending through the edge surface of each said weir; and means for extracting the liquids from inside said plurality of cylindrical hollow bodies.

* * * * *

UNITED STATES PATENT AND TRADEMARK OFFICE

CERTIFICATE OF CORRECTION

PATENT NO. : 6,063,274
DATED : May 16, 2000
INVENTOR(S) : Ceferino Aponte Rivera It is certified that error appears in the above-identified patent and that said Letters Patent is hereby corrected as shown below:

Column 4,
Line 44, before 'mat', delete "olcophilic" and insert -- oleophilic --.

Column 10, claim 12,
Line 18, after 'ellipse,', delete "an" and insert -- and said --.

Signed and Sealed this

Eleventh Day of September, 2001

*Attest:*

Nicholas P. Godici

*Attesting Officer*

NICHOLAS P. GODICI
*Acting Director of the United States Patent and Trademark Office*